United States Patent [19]

Gregson et al.

[11] Patent Number: 4,696,090

[45] Date of Patent: Sep. 29, 1987

[54] REMOVABLE BLADE ASSEMBLY

[75] Inventors: Donald L. Gregson, Oxnard; John J. McGuigan, Studio, both of Calif.

[73] Assignee: Harris Corporation, Melbourne, Fla.

[21] Appl. No.: 861,206

[22] Filed: May 8, 1986

[51] Int. Cl.[4] ..... H01R 43/00

[52] U.S. Cl. ..... 29/566.4; 7/107; 29/278; 29/758

[58] Field of Search ..... 29/566.4, 566.3, 566.2, 29/566.1, 278, 758, 33 M, 751; 7/107, 130, 131, 133; 279/79

[56] References Cited

U.S. PATENT DOCUMENTS

| | | | |
|---|---|---|---|
| 3,224,082 | 12/1965 | Moulin | 29/278 X |
| 3,844,153 | 10/1974 | Rose | 29/566.4 X |
| 3,883,316 | 5/1975 | Mason | 29/566.4 |
| 3,898,724 | 8/1975 | Condrich | 29/566.4 |
| 3,906,608 | 9/1975 | Charron | 29/566.4 |
| 4,161,061 | 7/1979 | Mason et al. | 29/566.4 |
| 4,241,496 | 12/1980 | Gregson | 29/758 |
| 4,434,542 | 3/1984 | Forberg et al. | 29/566.4 |

*Primary Examiner*—William R. Briggs

*Attorney, Agent, or Firm*—Harry M. Fleck

[57] ABSTRACT

A removable blade assembly is provided for use with an impact termination tool to insert electrical conductors into termination clips and sever the end of the conductor. The blade assembly includes a scissors type cutter which is operated in conjunction with the impact operation under the influence of a biasing spring and cam follower associated with the movable cutting blade. Cutting is achieved either during wire insertion or subsequently upon impact, depending upon the amount of cutting resistance encountered. A wire removal hook is provided at the end of the blade assembly and is within the impact tool handle during impact operation. The blade assembly may be easily removed from the impact tool for replacement, storage, or use of the wire removal hook.

20 Claims, 7 Drawing Figures

REMOVABLE BLADE ASSEMBLY

BACKGROUND OF THE INVENTION

1. Field of the Invention

The present invention is generally related to a blade assembly for use in a termination tool, and more particularly, to a blade assembly which is readily removable from an impact termination tool for replacement, storage, or use of an associated wire removal hook.

2. Description of the Relevant Art

Termination tools for terminating electrical conductors at terminal clips or blocks are widely used in the telephone industry. One such tool is described in U.S. Pat. No. 4,241,496, issued Dec. 30, 1980. This patent discloses an impact termination tool with means for selectively adjusting the impact force and means for easily mounting and removing reversible termination tool blades. The blades of the type disclosed in this patent do not lend themselves to seating and cutting conductors at terminal blocks of a design requiring a scissors type cutting action. One such blade mechanism is disclosed in U.S. Pat. No. 4,434,542, issued Mar. 6, 1980. This patent discloses a wire insertion tool with an impact mechanism and integral insertion and scissors cutting mechanism. The scissors cutting mechanism is not readily removable from the handle portion of the tool as may be desired for storage or replacement.

There is a need for a scissors type blade assembly which is readily removable from the impact termination tool to accommodate storage, replacement, or substitution of different type blades.

SUMMARY OF THE INVENTION

A blade assembly for use with a termination tool is disclosed which is readily removable for replacement, storage, or wire removal. The removable assembly has a self-contained mechanism for effecting scissor cuts of wires being inserted into termination clips. Manual pressure applied through the termination tool overcomes the force of an internal compression spring to move the assembly toward a retracted position and sever the electrical conductor as it is seated into the termination clip. The assembly also bears a hook portion at the end normally disposed within the termination tool. This hook may be utilized upon removal of the blade assembly to manually grasp conductors and pull such from terminal clips.

It is a general object of the present invention to provide a termination tool scissor blade assembly which is readily removable for replacement, storage, or use as wire removal device.

Another object of the present invention is to provide a removable blade assembly which is of relatively low-cost, simple construction.

It is a further object of the present invention to provide a removable blade assembly for use with a conventional impact termination tool to achieve insertion of electrical conductors into terminal clips and to simultaneously sever the conductor end to a predetermined dimension.

Another object of the present invention is to provide a removable scissor blade assembly with self-contained mechanism for effecting scissor cutting of electrical conductors.

DESCRIPTION OF THE PREFERRED EMBODIMENT

Figure 1:
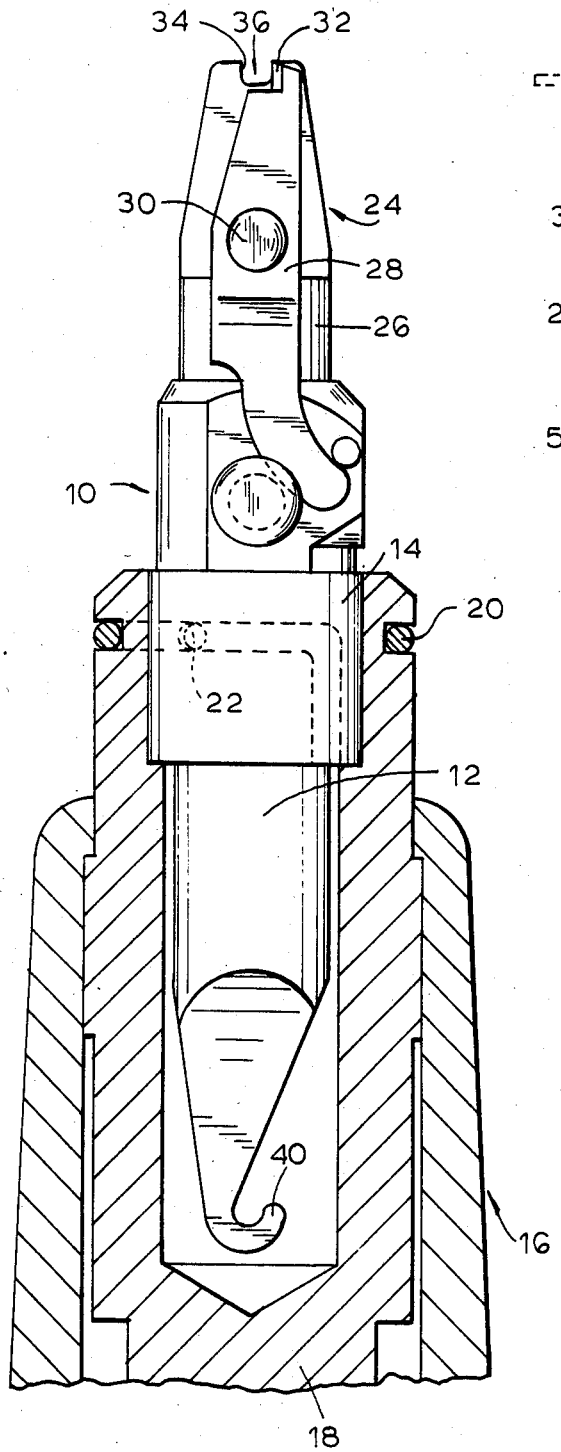
FIG. 1 is a partial sectional view of an impact termination tool with the blade assembly mounted therein.
Figure 2:
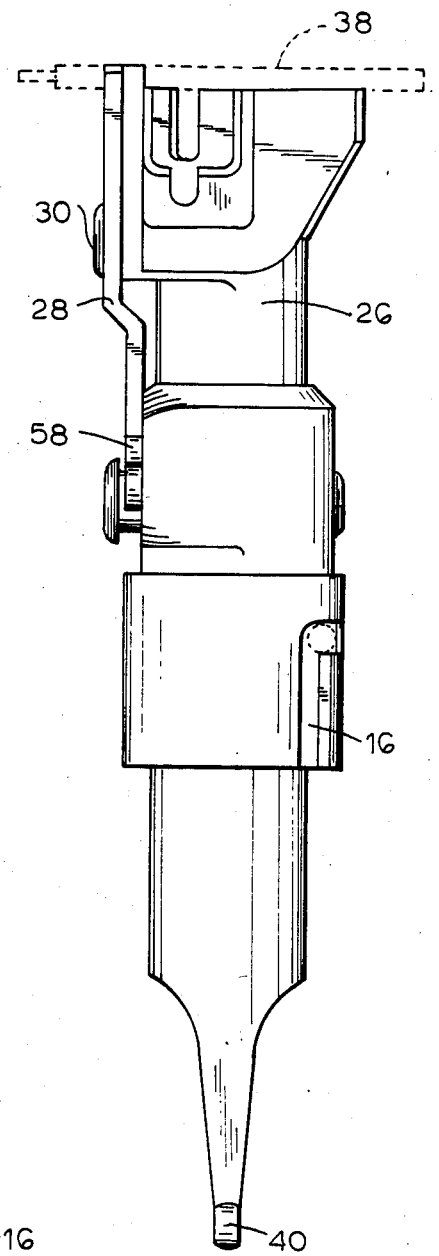
FIG. 2 is a plan view of the removable blade assembly.

Referring now, more particularly, to FIGS. 1 and 2 of the drawings, the blade assembly of the present invention is generally indicated by the numeral 10 and includes a main body 12 including a generally cylindrical collar portion 14 with an L-shaped mounting slot 16.

The end portion of an impact termination tool is generally indicated by the numeral 16 and includes an impact slide 18 which carries a cam lock spring 20 having an end portion 22 which cooperates with the L-shaped slot 16 to lock the blade assembly in place. The blade assembly may be easily removed by partial rotation thereof relative to the impact tool, followed by a pulling motion, such that end 22 of the cam lock spring follows the path of mounting slot 16. This easy mounting and removal procedure is described in more detail in U.S. Pat. No. 4,161,061, issued July 17, 1979.

The exposed end portion of the blade assembly is provided with a scissor type cutting mechanism generally indicated by the numeral 24, carried by a slide member 26 which is slidably mounted in the main body 12. The cutting mechanism includes a movable blade or cutting member 28, pivotally mounted to slide member 26 by way of a pivot pin 30. Movable blade 28 includes a cutting edge or surface 32 which cooperates with an oppositally disposed cutting surface 34 at the end of slide 26.

When the blade assembly is in the extended position as illustrated in FIGS. 1 and 2, the space between cutting surfaces 32 and 34 define a wire-receiving slot, generally indicated by numeral 36. During the insertion operation, the wire or electrical conductor, shown in dash line at 38 in FIG. 2, passes through slot 36 and is pressed into the termination clip by the distal end portion of the blade assembly. The opposite end of the blade assembly is provided with a wire removal means, preferably, in the form of a wire pulling hook 40. Hook 40 is affixed to the end of main body 12 and is intended for manually removing wires from terminal clips when the blade assembly is removed from the termination tool.

Figure 3:
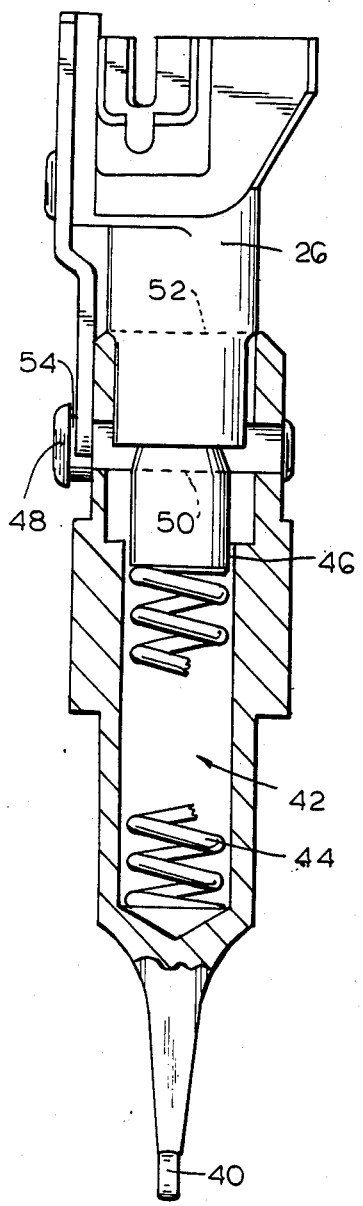
FIG. 3 is a plan view of the removable blade assembly in the extended position, with sections removed.
Figure 4:
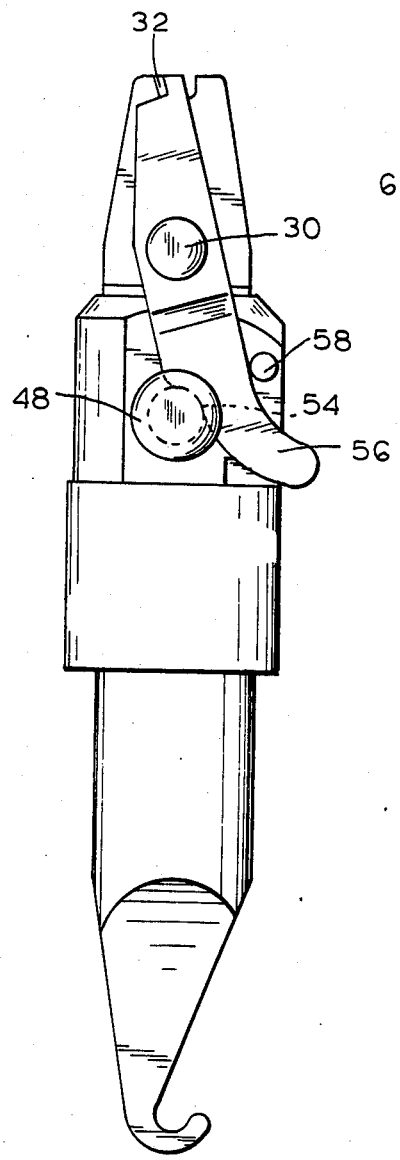
FIG. 4 is a side elevational view of the blade assembly in the retracted position.
Figure 5:
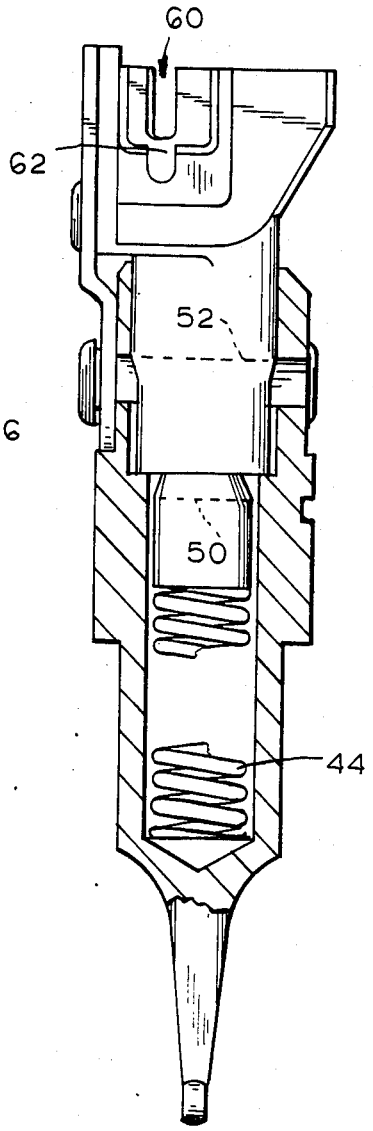
FIG. 5 is a plan view of the removable blade assembly in the retracted position, with sections removed.
Figure 6:
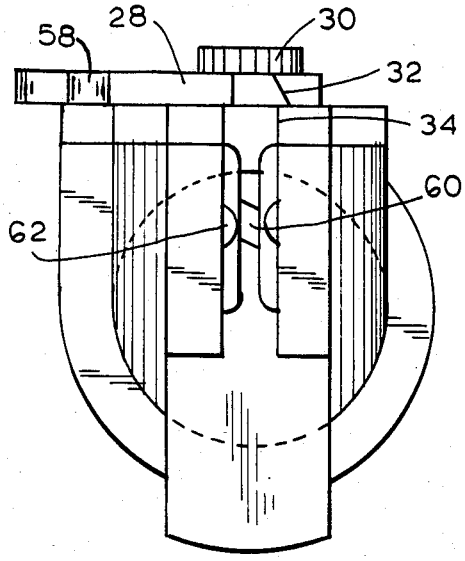
FIG. 6 is an end elevational view of the blade assembly in the retracted position.

Referring now, more particularly, to FIGS. 3 through 6, operation of the removable blade assembly may be more fully understood. The main body 12 includes a hollow opening defining a cavity 42, containing a coil compression spring 44. Slide member 26 includes an end surface 46 which is engaged by one end of compression spring 44, which yieldably biases the slide member to the extended position, as shown in FIG. 3. A guide pin 48 also provides a cam surface 54 which cooperates with a corresponding surface on a cam follower portion 56 of the movable cutting member 28. Cam follower 56 also cooperates with a second cam surface defined by a circular pin or nub 58 affixed to the main body of the blade assembly. Cam member 58 serves to return movable cutting member 28 to its original position as the assembly moves from the retracted position shown in FIGS. 4 and 5 to the extended position shown in FIG. 3.

The wire insertion end portion of the blade assembly is provided with a U-shaped slot generally indicated the numeral 60 which is configured to accommodate a correspondingly shaped portion of the terminal clips being utilized. A U-shaped indentation 62 is also provided to accommodate the configuration of the particular terminal clips. The configuration illustrated in the drawings is intended for use with insulation displacement terminal blocks of the type marketed by Krone GmbH and identified as "LSA-Plus". However, it is not intended that the present invention be limited to use with this type of terminal, as minor changes in configuration of the blade assembly should be apparent to those skilled on the art to accommodate other terminal configurations requiring scissor cutting of the conductors.

It will be apprecitated that as the blade assembly is moved to the retracted position, movable cutting member 28 is pivoted about pivot pin 30 to sever the electrical conductor with cutting surfaces 32 and 34. During this operation, manual force applied through the handle of the impact termination tool causes partial compression of spring 44 to the position illustrated in FIG. 5.

Figure 7:
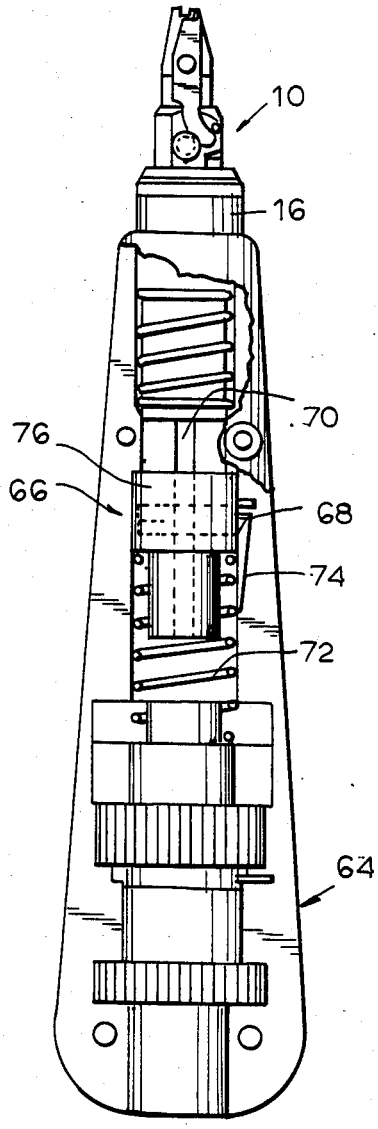
FIG. 7 Is a plan view of the blade assembly mounted in an impact termination tool with sections removed.

Referring now, more particularly, to FIG. 7 of the drawings, operation of the blade assembly of the present invention with the impact termination tool may be more fully understood. The impact termination tool generally indicated by numeral 64 is a commercially available device sold by the Dracon Division of Harris Corporation as Model HD 8762/D814. Operation of the impact tool is described in U.S. Pat. No. 4,241,496, issued Dec. 30, 1980. As described in the aforementioned patent, a hammer assembly, generally indicated by numeral 66, has a sear pin 68 urged into an extended position laterally therefrom by an internal spring (not shown). As impact slide 16 is forced inwardly from its extended position, a projecting pin 70 carried thereon forces impact assembly 66 toward the rear end of the impact tool against an impact drive spring 72 bearing thereagainst. As the hammer assembly 66 is moved toward the rear of the impact tool, a ramp 74 forces sear pin 68 laterally inward. When a hole (not shown) in sear pin 68 is aligned with projecting pin 70 through the lateral motion of the sear pin, impact drive spring 72 drives impact assembly 66 toward pin 70. Hammer mass 76 impacts an anvil surface at the end of pin 70, thereby delivering an impact to slide 16 and to the blade assembly 10.

For most wire insertion and cutting operations utilizing the described impact tool and removable blade assembly, the electrical conductor is severed prior to impact. However, in some circumstances, severing may not occur until impact. For example, if a harder than normal wire is to be severed or if the cutting surfaces have become dull through use, the normal forces imparted prior to impact may be insufficient for completely severing the conductor. In such events, the impact force created by the termination tool will effect severing of the conductor as well as completing the wire insertion operation into the terminal clip.

Based upon the foregoing description, it will be apparent that the removable blade assembly of the present invention provides a unique means for accomplishing both cutting and wire insertion into terminal clips of the type requiring a scissors cut operation. Furthermore, the present invention is readily removable from an impact termination tool, which also accommodates conventional wire insertion blades. The blade assembly may be removed for storage, or replacement due to wear, without the need to replace the entire impact tool. Also, the wire removal hook is readily accessible upon removal of the blade assembly to pull wires previously mounted to terminal blocks. Cooperation between the impact spring of the termination tool and the blade assembly assures proper cutting, even under adverse conditions.

What is claimed:

1. A removable blade assembly adapted for use with a termination tool of the type used to connect an electrical conductor to a terminal clip comprising:

a main body with an elongated opening therein defining a cavity, a slide member slidably connected to said main body and movable between an extended position and a retracted position, biasing means disposed within said cavity for yieldably biasing said slide member toward said extended position, said slide member including a first end portion extending into said cavity and operatively engaging said biasing means, and a second end portion opposite said first end portion including means for pressing the electrical conductor into engagement with the terminal clip, cutting means for severing the electrical conductor upon insertion into the terminal clip, said cutting means including a movable cutting member pivotally mounted to said second end portion of said slide member, said movable cutting member including a first cutting surface adapted to engage the electrical conductor and the cam follower, said cutting means further including a second cutting surface carried by said slide member and oppositely disposed of said first cutting surface of said movable cutting member, cam means attached to said main body for cooperation with said cam follower to pivot said cutting member upon movement of said slide member between said extended position and said retracted position to sever the electrical conductor during movement of said slide member toward said retracted position, and releasable fastening means associated with said main body for removably mounting said blade assembly in the termination tool.

2. The removable blade assembly set forth in claim 1 further including wire removal means for removing a conductor from the terminal clip.

3. The removable blade assembly set forth in claim 2 wherein wire removal means is adapted to extend into the termination tool when the blade assembly is mounted therein.

4. The removable blade assembly set forth in claim 3 wherein said wire removal means is attached to said main body at one end thereof opposite said opening.

5. The removable blade assembly set forth in claim 4 wherein said wire removal means comprises a wire pulling hook.

6. The removable blade assembly set forth in claim 5 wherein said wire pulling hook is integrate with said main body.

7. The removable blade assembly set forth in claim 1 wherein said cam means further includes return means for returning said movable cutting member to its original position upon movement of said slide member from said retracted position to said extended position.

8. The removable blade assembly set forth in claim 7 wherein said return means comprise a return cam affixed to said main body.

9. The removable blade assembly set forth in claim 1 wherein said biasing means comprises a spring disposed in said cavity and in operative with said main body and said slide member.

10. The removable blade assembly set forth in claim 9 wherein said spring comprised a coil compression spring having one end which operatively engages said main body and an opposite end which operatively engages said slide member.

11. The removable blade assembly set forth in claim 1 wherein said first and second cutting surfaces define a wire-receiving slot when said slide member is in said extended position, said wire-receiving slot being adjacent said means for pressing the electrical conductor into engagement with the terminal clip.

12. A device for terminating electrical conductors at termination clips, comprising:

a manually operable handle, an impact slide inside said handle mounted for sliding lengthwise movement therein, means mounted in said handle for yieldably urging said impact slide outwardly therefrom, for limiting outward movement of said slide, and for impacting said slide, a removable blade assembly, means for removably interlocking said removable blade assembly with said impact slide, so that when the electrical conductor is positioned adjacent to the terminal clip and said removable blade assembly is forced thereagainst, the conductor is seated therein by the impact of said impact slide, said removable blade assembly comprising:

a main body with an elongated opening therein defining a cavity, a slide member slidable connected to said main body and movable between an extended position and a retracted position, biasing means disposed within said cavity for yieldably biasing said slide member toward said extended position, said slide member including a first end portion extending in to said cavity and operatively engaging said biasing means, and a second end portion opposite said first end portion including means for pressing the electrical conductor into engagement with the terminal clip, cutting means for severing the electrical conductor, and means connected to said main body for causing operation of said cutting means to sever the electrical conductor during movement of said slide member toward said retracted position.

13. The device set forth in claim 12 wherein said cutting means comprises a scissor mechanism for severing the electrical conductor.

14. The device set forth in claim 12 wherein said means for causing operation of said cutting means comprises cam means attached to said main body.

15. The device set forth in claim 14 wherein said cutting means includes a movable cutting member pivotally mounted to said second end portion of said slide member, said movable cutting member including a first cutting surface adapted to engage the electrical conductor and including a cam follower, said cutting means further including a second cutting surface carried by said slide member and oppositely disposed of said first cutting surface of said movable cutting member, said cam means cooperating with said cam followers to pivot said cutting member upon movement of said slide member between said extended position and said retracted position.

16. The device set forth in claim 12 wherein said removable blade assembly includes wire removal means for removing a conductor from the terminal clip.

17. The device set forth in claim 16 wherein said wire removal means extends into said impact slide when said blade assembly is mounted therein.

18. The device set forth in claim 17 wherein said wire removal means is attached to said main body at one end thereof opposite said opening.

19. The device set forth in claim 18 wherein said wire removal means comprises a wire pulling hook.

20. The device set forth in claim 12 wherein said biasing means comprises a coil compression spring having one end which operatively engages said main body and an opposite end which operatively engages said slide member.

* * * * *